US006435166B1

(12) United States Patent
Sato et al.

(10) Patent No.: US 6,435,166 B1
(45) Date of Patent: Aug. 20, 2002

(54) EXHAUST GAS RECIRCULATION DEVICE AND CONTROL METHOD THEREOF

(75) Inventors: Fumihide Sato; Kunihiko Komiyama; Yasuyuki Onodera; Yoshiki Kanzaki, all of Oyama (JP)

(73) Assignee: Komatsu Ltd., Tokyo (JP)

( * ) Notice: Subject to any disclaimer, the term of this patent is extended or adjusted under 35 U.S.C. 154(b) by 13 days.

(21) Appl. No.: 09/593,672

(22) Filed: Jun. 14, 2000

(30) Foreign Application Priority Data

Jun. 16, 1999 (JP) ..... 11-169598

(51) Int. Cl.[7] ..... F02M 25/07

(52) U.S. Cl. ..... 123/568.12; 123/568.21; 60/605.2

(58) Field of Search ..... 123/568.11, 568.12, 123/568.21; 60/278, 605.2

(56) References Cited

U.S. PATENT DOCUMENTS 3,703,164 A * 11/1972 Weaving ..... 123/568.11
5,657,630 A * 8/1997 Kjemtrup et al. ..... 123/568.12
5,791,146 A * 8/1998 Dungner ..... 60/605.2
5,937,650 A * 8/1999 Arnold ..... 60/605.2
5,974,802 A * 11/1999 Blake ..... 60/605.2
6,041,602 A * 3/2000 Dickey ..... 60/605.2
6,152,118 A * 11/2000 Sasaki et al. ..... 60/278
6,154,071 A * 12/2000 Shao et al. ..... 60/605.2

FOREIGN PATENT DOCUMENTS

JP 5-30454 4/1993
JP 6-229326 8/1994

* cited by examiner

*Primary Examiner*—Willis R. Wolfe

(57) ABSTRACT

A Roots blower driven by a direct-current motor provided to a recirculation duct for connecting an exhaust duct and an intake duct to extract a part of exhaust gas of a diesel engine to recirculate to an intake side. Accordingly, even when a differential pressure between an exhaust side and the intake side, or even when a pressure on the intake side is higher than the exhaust side fluctuates, the exhaust gas flowing to the recirculation duct can be forcibly pumped by the Roots blower while appropriately controlling flow rate thereof, so that an optimum recirculation amount of exhaust gas in accordance with operation condition of the diesel engine can be recirculated to the intake side.

11 Claims, 11 Drawing Sheets

EXHAUST GAS RECIRCULATION DEVICE AND CONTROL METHOD THEREOF

BACKGROUND OF THE INVENTION

1. Field of the Invention

The present invention relates to an exhaust gas recirculation device for removing nitrogen oxide from the exhaust gas of an internal combustion engine and control method thereof.

2. Description of the Related Art

Conventionally, exhaust gas recirculation (EGR) for returning a part of exhaust gas to intake side is used for reducing nitrogen oxide, so-called NOx, contained in the exhaust gas of an internal combustion engine, especially a reciprocating engine.

According to the exhaust gas recirculation, a gas having a large thermal capacity, such as carbon dioxide and water vapor, is mixed into combustion air supplied to the internal combustion engine to increase thermal capacity of the air, so that maximum combustion temperature is lowered, thus decreasing the level of nitrogen oxide.

An example of an internal combustion engine using the exhaust gas recirculation is shown in Japanese Utility Model Laid-Open Publication No. Hei 5-30454. According to the exhaust gas recirculation system in the publication, a part of the exhaust gas of the engine is returned to the intake side of a supercharger.

Accordingly, even when exhaust gas pressure is insufficient for returning the part of the exhaust gas, the part of the exhaust gas is securely fed to intake side of the engine by suction force of the supercharger, so that the recirculation rate can be improved.

Another internal combustion engine having high-load EGR duct and low-load EGR duct is shown in Japanese Patent Laid-Open Publication No. Hei 6-229326.

The high-load EGR duct introduces a part of the exhaust gas from downstream of catalyst to return to intake side of the supercharger. On the other hand, the low-load EGR duct introduces a part of the exhaust gas from an exhaust manifold and returns the exhaust gas to around the intake port of respective cylinders.

Accordingly, the high-load EGR duct and the low-load EGR duct can be switched in accordance with the load applied to the engine, so that a more appropriate amount of the exhaust gas can be recirculated as compared to one EGR duct.

In the internal combustion engine employing exhaust gas recirculation, when differential pressure on the exhaust side and the intake side fluctuates, because flow rate of the exhaust gas flowing in the exhaust gas recirculation duct also fluctuates, the recirculation rate cannot be controlled at a constant level.

Accordingly, a predetermined amount of the exhaust gas does not recirculate to the intake side even when the recirculation amount is set in accordance with operation of the internal combustion engine, so that it is difficult to set an optimum amount of exhaust gas in accordance with the internal combustion engine.

A flow control valve maybe provided to the exhaust gas recirculation duct to control the flow rate of the exhaust gas flowing through the exhaust gas recirculation duct. However, the flow control valve increases the flow restriction of the exhaust gas recirculation duct, so that necessary recirculation cannot be obtained when differential pressure between the exhaust side and the intake side is low.

Especially, in a diesel engine having a supercharger, the pressure on the exhaust gas side can be higher than the intake side according to an operation condition, thereby making it impossible to recirculate the exhaust gas to the intake side.

SUMMARY OF THE INVENTION

An object of the present invention is to provide an exhaust gas recirculation device for recirculating an appropriate amount of exhaust gas in accordance with an operation condition of an internal combustion engine and a control method thereof.

A device according to the present invention is an exhaust gas recirculation device for extracting a part of an exhaust gas of an internal combustion engine and recirculating the exhaust gas into an intake side, the exhaust gas recirculation device having a gas feeder installed on a recirculation duct connecting an exhaust duct and an intake duct of the internal combustion engine.

As the gas feeder, an airblower capable of pumping gas through narrow space such as a duct and a compressor for compressing fluid inhaled through an air intake to blow out from an air outlet can be used.

For instance, a Roots blower, an axial-flow air blower and a centrifugal air blower can be used for the air blower as the gas feeder.

A reciprocating compressor, a screw compressor, a vane compressor, a scroll compressor, an axial-flow compressor and a centrifugal compressor can be used for the compressor as the gas feeder.

A drive source for driving the gas feeder may be a drive source independent from the internal combustion engine, such as a direct-current motor, an alternating-current motor, a hydraulic motor and an air motor, or may be the internal combustion engine itself.

Accordingly, because the part of the exhaust gas is forcibly pumped to the intake side by the gas feeder, even when differential pressure between the exhaust side and the intake side fluctuates, the flow rate of the exhaust gas flowing through the exhaust gas recirculation duct can be adjusted to a constant level by appropriately controlling the drive source for driving the gas feeder, so that the recirculation amount can be controlled to make the recirculation rate constant.

Therefore, even when the pressure on the intake side is than the exhaust side, a predetermined amount of exhaust gas can be recirculated to the intake side by setting an optimum amount of recirculation in accordance with an operation condition of the internal combustion engine and controlling the drive source to recirculate the preset recirculation amount.

In the device of the present invention, at least one of an air mixer for mixing outside fresh air with the exhaust gas recirculating to the intake side, a water mixer for mixing water with the exhaust gas recirculating to the intake side, and a cooler for cooling the exhaust gas recirculating to the intake side may preferably be provided between the gas feeder and an exhaust side of the internal combustion engine.

By providing the air mixer, the high-temperature exhaust gas is mixed with low-temperature air, thus lowering the temperature of recirculating exhaust gas. The outside fresh air may be the air directly inhaled from the outside of the internal combustion engine, or alternatively, may be a part of intake air introduced from air intake for combustion.

Using the water mixer, the temperature of the high-temperature exhaust gas can be lowered by mixing low-temperature water and the temperature of the recirculated exhaust gas can be further lowered by heat of evaporation when the water is evaporated.

The cooler may be a liquid-cooling type for cooling the exhaust gas by a cooling medium such as water, an evaporative cooling type for cooling the exhaust gas by the heat of evaporation of liquid, or an air-cooling type for cooling the exhaust gas by ambient air, which cools the high-temperature exhaust gas to lower the temperature of the recirculated exhaust gas.

According to the above, the high-temperature exhaust gas does not flow into the gas feeder, so that damage to the gas feeder by heat can be prevented and, furthermore, because the temperature of the intake air inhaled by the internal combustion engine does not get too high, so that the combustion temperature can be securely curbed by the exhaust gas recirculation.

In the device of the present invention, the gas feeder, a drive source for driving the gas feeder and the cooler may preferably be integrated as a unit.

Accordingly, the device can be easily attached and detached to the internal combustion engine. Therefore, the exhaust gas recirculation device can be easily installed to a conventional internal combustion engine having no exhaust gas recirculation device.

When the internal combustion engine is run at a place with thin air such as a place at a high altitude where the internal combustion engine does not work stably at a high load with exhaust gas recirculation, the exhaust gas recirculation device unit can be detached from the internal combustion engine, so that the internal combustion engine can be operated stably at high load. Incidentally, the nitrogen oxide in the exhaust gas can be reduced at the place with thin air even without the exhaust gas recirculation.

On the other hand, the nitrogen oxide contained in the exhaust gas of the internal combustion engine can be reduced in a place of ordinary air pressure by attaching the exhaust gas recirculation device unit to the internal combustion engine.

In the device of the present invention, the gas feeder may preferably be capable of rotating in both normal and reverse directions, a rotation in the normal direction circulating fluid in reverse to a rotation of the reverse direction, and a controller for controlling the gas feeder may preferably be provided, the controller controlling rotary direction of the gas feeder in accordance with an operation condition of the internal combustion engine and reversely rotating the gas feeder when the exhaust gas is not recirculated to the internal combustion engine.

The gas feeder may be a Roots blower, an axial-flow air blower, a screw compressor or a vane compressor.

Accordingly, when the exhaust gas recirculation is not conducted, even if the pressure at the exhaust side is greater than that of the intake side, the flow from the exhaust side to the intake side can be prevented by the reverse rotation of the gas feeder.

Accordingly, the control valve for preventing the flow from the exhaust side to the intake side is not necessary to be provided to the recirculation duct, so that an increase in the flow restriction by the provision of the control valve and decrease in exhaust gas recirculation amount in accordance with an increase in the flow restriction can be prevented in advance.

Further, by the reverse rotation of the gas feeder, when the recirculating exhaust gas is cooled by the cooler, soot and contaminant stuffed in the cooler are discharged to the exhaust side, thus cleaning the cooler.

In the device of the present invention, the gas feeder may preferably a Roots blower.

Because the Roots blower can be operated at a relatively low speed, the size of the drive source can be made small. Further, because the size of the Roots blower itself is relatively small, an increase in the size of the exhaust gas recirculation device can be prevented.

Because the flow characteristics of the Roots blower are similar in both the normal rotation and the reverse rotation, the relationship between the rotation speed and the air feed amount is similar in both the normal rotation and the reverse rotation except for the rotary direction, thus easily preventing backflow and conducting control of the rotation speed during cleaning the cooler.

In the device of the present invention, a catalyst for cleaning the exhaust gas may preferably be provided to the exhaust duct of the internal combustion engine, and a part of the exhaust gas may preferably be extracted from a downstream of the catalyst to be recirculated.

Accordingly, because the exhaust gas is extracted from a downstream side of the catalyst, the exhaust gas returning to the intake side is cleaned and the temperature of the exhaust gas is reduced, thus decreasing damage and abrasion of the equipment installed on the recirculation duct such as the gas feeder and, when the cooler is installed in the recirculation duct, the volume of the cooler can be reduced.

In the device of the present invention, the gas feeder may preferably be capable of adjusting air feed flow rate, and the exhaust gas recirculation device may preferably have an engine speed detector for detecting an engine speed of the internal combustion engine, a fuel supply detector for detecting fuel supply to the internal combustion engine, a memory for storing a map indicating a rotation speed of the gas feeder capable of obtaining an optimum exhaust gas recirculation amount in accordance with the engine speed of the internal combustion engine and the fuel supply to the internal combustion engine, and a controller for adjusting the air feed flow rate of the gas feeder based on the map stored in the memory in accordance with an operation condition of the internal combustion engine.

Accordingly, the engine speed and the fuel supply amount can be detected by the engine speed detector and the fuel supply detector. By acquiring the rotation speed of the gas feeder capable of obtaining the exhaust gas recirculation amount in accordance with operation condition of the internal combustion engine relative to the engine speed and the fuel supply through experiment and calculation, a map indicating an optimum rotation speed relative to the engine speed and fuel supply can be obtained.

By providing a memory for storing the aforesaid map, the rotation speed of the gas feeder can be rapidly adjusted so that the optimum exhaust gas recirculation amount can be obtained, thus securely recirculating the optimum amount of exhaust gas in accordance with an operation condition of the internal combustion engine.

A method of the present invention is a control method of an exhaust gas recirculation device for extracting a part of exhaust gas of an internal combustion engine to recirculate to an intake side. The method includes the steps of: providing to the exhaust gas recirculation device a gas feeder installed to a recirculation duct for connecting an exhaust duct and an intake duct of the internal combustion engine and a drive source for driving the gas feeder, the gas feeder controlling a rotation speed of the drive source to control air feed flow rate; and controlling a rotation speed of the drive source to obtain an optimum exhaust gas recirculation amount in accordance with operation condition of the internal combustion engine.

According to the above, by employing the gas feeder, such as a Roots blower, capable of adjusting flow rate by adjusting rotation speed thereof, the exhaust gas recirculation amount sent to the intake side of the internal combustion engine can be easily adjusted by adjusting the rotation speed of the drive source for driving the gas feeder. Further, by employing an electric motor such as direct current motor, the rotation speed can be easily and rapidly changed, thus ensuring appropriate exhaust gas recirculation amount in accordance with operation condition of the internal combustion engine.

Another method of the present invention is a control method of an exhaust gas recirculation device for extracting apart of exhaust gas of an internal combustion engine to recirculate to an intake side, the method having the steps of: providing to the exhaust gas recirculation device a gas feeder installed to a recirculation duct for connecting an exhaust duct and an intake duct of the internal combustion engine and a drive source for driving the gas feeder, the gas feeder being capable of rotating in both normal and reverse directions, rotation in the reverse direction circulating fluid in a direction reverse to rotation in the normal direction; and reversely rotating the gas feeder to prevent backflow from the intake side to the exhaust side when the exhaust gas is not recirculated to the internal combustion engine.

Accordingly, as described in the aforesaid device of the present invention, the backflow from the intake side to the exhaust side can be prevented by the reverse rotation of the gas feeder when the exhaust gas is not recirculated to the internal combustion engine and the recirculation duct including the cooler can be cleaned.

DETAILED DESCRIPTION OF PREFERRED EMBODIMENT(S)

An embodiment of the present invention will be described below with reference to attached drawings.

Figure 1:
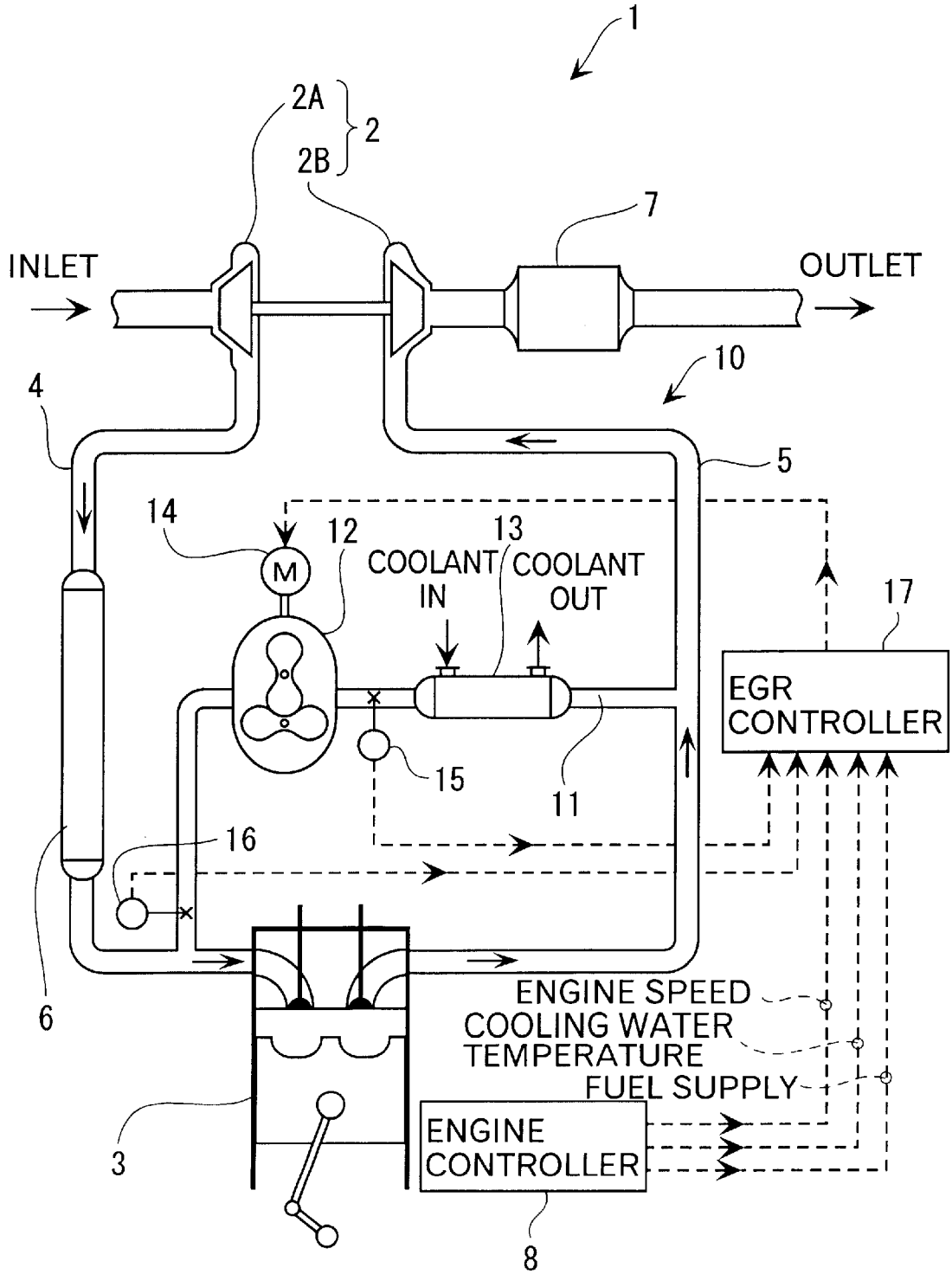
FIG. 1 is a schematic diagram showing a diesel engine as an internal combustion engine according to a first embodiment of the present invention.

FIG. 1 shows a diesel engine 1 as an internal combustion engine according to first embodiment of the present invention. The diesel engine 1 has an exhaust gas recirculation device 10 for extracting a part of the exhaust gas to recirculate to intake side.

The diesel engine 1 conducts supercharging by a turbocharger 2 and has an intake duct 4 for introducing fresh air from the outside to a cylinder 3 and an exhaust duct 5 for discharging the exhaust gas from the cylinder 3 to the outside.

A centrifugal intake-air compressor 2A and an air-cooling inter cooler 6 for cooling the intake air compressed by the centrifugal intake-air compressor 2A is provided to the intake duct 4.

The exhaust duct has an exhaust gas turbine 2B for driving the centrifugal intake-air compressor 2A on the intake side and a catalyst 7 for cleaning the exhaust gas on downstream side of the exhaust gas turbine 2B.

The turbocharger 2 has the centrifugal intake-air compressor 2A on the intake side and the exhaust gas turbine 2B on the exhaust side.

The exhaust gas recirculation device 10 has a recirculation duct 11 for connecting the intake duct 4 and the exhaust duct 5 of the diesel engine 1 and recirculates exhaust gas by a Roots blower 12 as a gas feeder provided to the recirculation duct 11.

An end of the recirculation duct 11 is connected to a downstream side of the inter cooler 6 of the intake duct 4 and the other end is connected to an upstream side of the exhaust turbine 2B of the exhaust duct 5.

The exhaust gas recirculation device 10 has, as well as the recirculation duct 11 and the Roots blower 12, a cooler 13 for cooling the exhaust gas sent to the Roots blower 12, a direct-current motor 14 for driving the Roots blower 12, a pressure sensor 15 for detecting inner pressure (static pressure) of the recirculation duct 11 between the Roots blower 12 and the cooler 13, a pressure sensor 16 for detecting inner pressure (static pressure) of the recirculation duct 11 adjacent to the intake port of the cylinder 3, and an EGR controller 17 as a controller for controlling the Roots blower 12. Among them, the pressure sensors 15 and 16 are electrically connected to the EGR controller 17 to output a pressure signal to the EGR controller 17.

The Roots blower 12 is capable of rotating in both normal and reverse directions, which pumps a part of the exhaust gas to the intake duct 4 during normal rotation and, during reverse rotation, pumps a part of the exhaust gas to the exhaust duct 5 in a reverse direction to the normal rotation.

The cooler 13 is a water-cooling type, where cooling water is circulated therein as a coolant to cool the exhaust gas.

The direct-current motor 14 is capable of rotation in both normal and reverse rotary directions and is capable of being driven at any rotation speed in a predetermined range.

The EGR controller 17 has a control function for adjusting rotary direction and rotation speed of the Roots blower 12 in accordance with operation condition of the diesel engine 1.

In order to detect the operation condition of the diesel engine 1, the EGR controller 17 is electrically connected to an engine controller 8 for controlling a fuel pump, etc., for injecting fuel into the cylinder 3.

Accordingly, engine speed signal indicating engine speed of the diesel engine outputted by the engine controller 8, a fuel supply signal indicating fuel amount injected into the cylinder 3, and a cooling water temperature signal indicating temperature of the cooling water of the engine 1 are inputted into the EGR controller 17.

Incidentally, although not shown, the diesel engine 1 has an engine speed sensor such as an engine speed detector for detecting the engine speed thereof and a rack sensor as a fuel supply detector for detecting a fuel amount injected into the cylinder 3. Among the sensors, the rack sensor detects a position of the rack being slidable relative to a plunger to control injected fuel amount from a fuel pump.

The above-described exhaust gas recirculation device 10 is constructed as a unit for facilitating attachment and detachment to the diesel engine 1.

Figure 2:
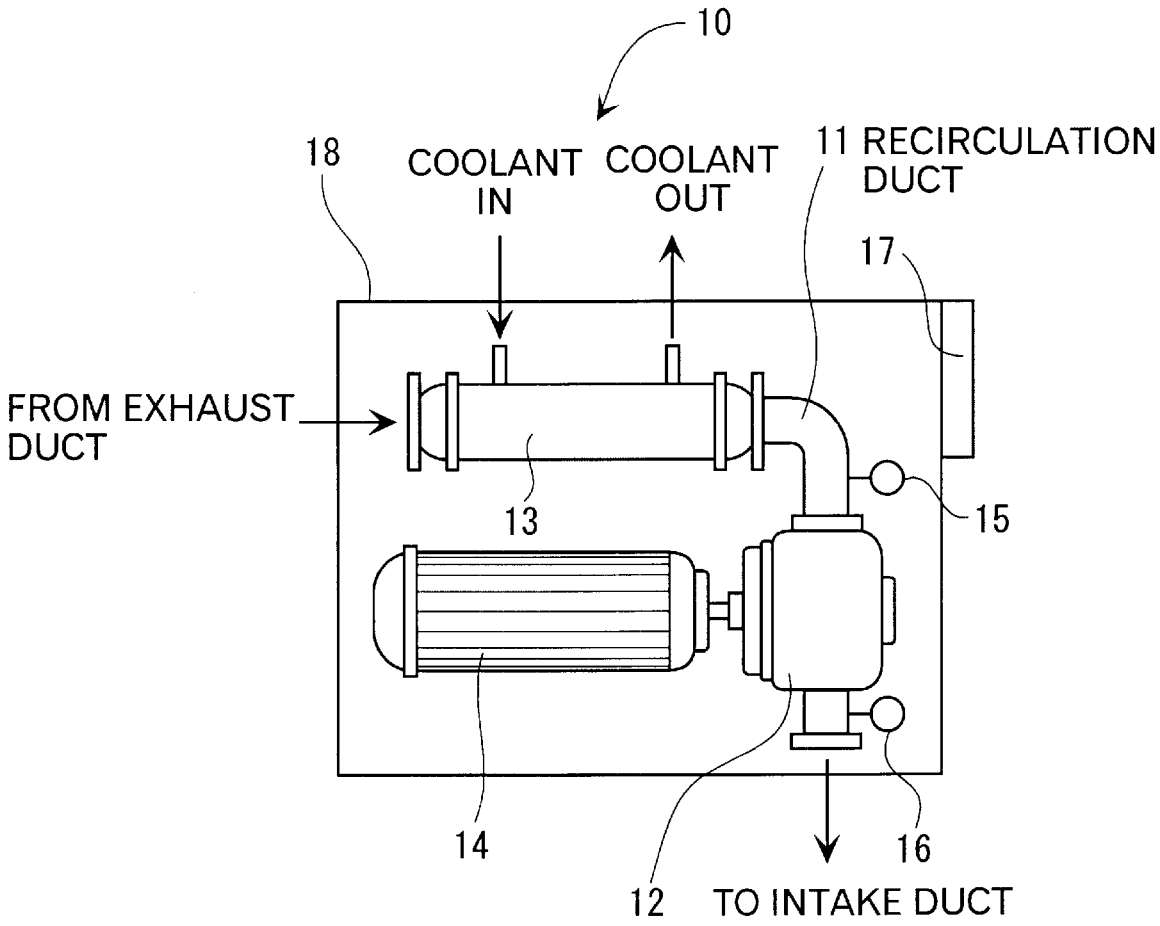
FIG. 2 is a front elevation showing an exhaust gas recirculation device unit of the aforesaid embodiment.

Specifically, as shown in FIG. 2, the recirculation duct 11, the Roots blower 12, the cooler 13, the direct-current motor 14, the pressure sensors 15 and 16 and the EGR controller 17 are installed in one casing 18 to be united, thus forming an exhaust gas recirculation device unit capable of being attached to the diesel engine 1 by a bolt, etc.

Next, the EGR controller 17 will be specifically described below.

The EGR controller 17 includes a microcomputer for controlling the Roots blower 12. Various software modules for controlling rotation speed of the direct-current motor 14 to adjust an air supply amount of the Roots blower 12 are installed in the microcomputer of the EGR controller 17.

Figure 3:
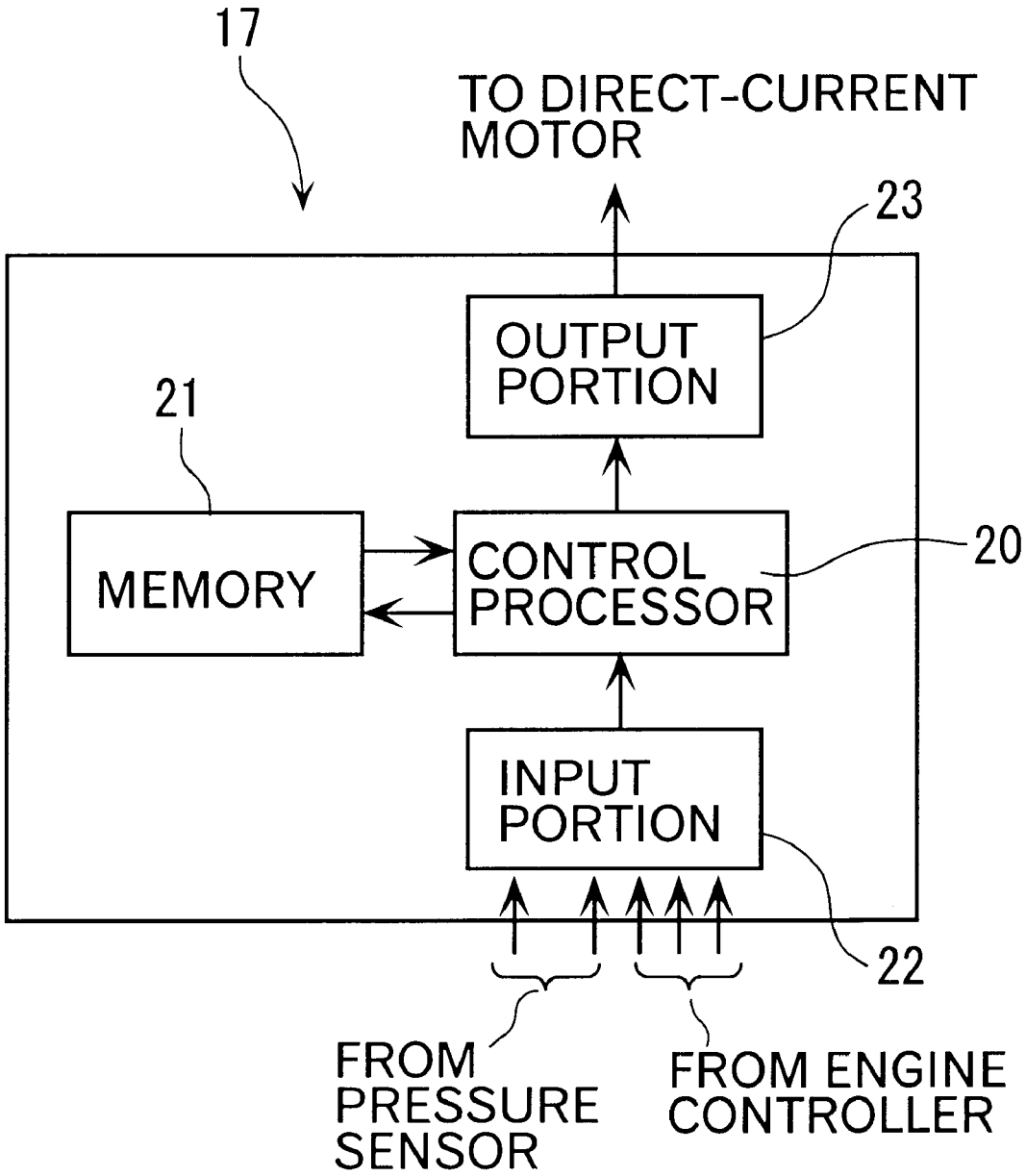
FIG. 3 is a block diagram showing a controller of the aforesaid embodiment.

More specifically, as shown in FIG. 3, the EGR controller 17 has a control processor 20 for determining rotation speed and rotary direction of the direct-current motor 14, a memory 21 as a storage means for storing a map indicating rotation speed of the Roots blower 12 for obtaining optimum exhaust gas recirculation amount in accordance with engine speed and fuel supply, an input portion 22 for inputting signals from the pressure sensors 15 and 16 and the engine controller 8, and an output portion 23 for outputting drive power to the direct-current motor 14.

Figure 4:
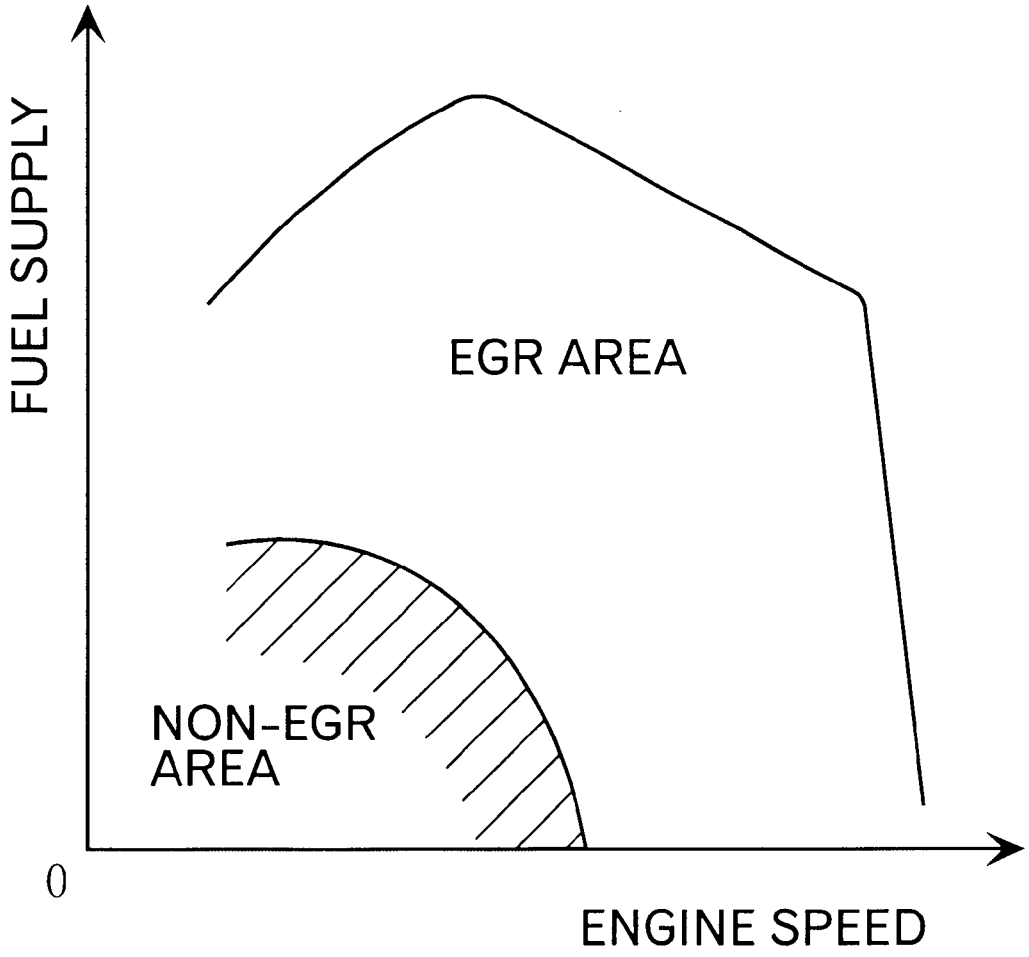
FIG. 4 is a graph showing an area for conducting exhaust gas recirculation in the internal combustion engine.

In the arrangement, a map indicating optimum exhaust gas recirculation rate relative to the engine speed and fuel supply is also stored in the memory 21. As shown in FIG. 4, the map includes a non-EGR area conducting no exhaust gas recirculation and an EGR area conducting the exhaust gas recirculation.

In the non-EGR area where both the engine speed and the fuel supply are relatively low, the diesel engine 1 is controlled not to conduct the exhaust gas recirculation because the combustion temperature of the engine 1 is low and only small amount of nitrogen oxide is generated. In the EGR area other than the non-EGR area, the diesel engine 1 is controlled to conduct the exhaust gas recirculation.

The control processor 20 of the EGR controller 17 has a software module for rotating the Roots blower 12 in normal direction during steady state where the engine speed of the diesel engine 1 is stable in the EGR area and for controlling rotation speed of the direct-current motor 14 based on the map of the memory 21.

Further, the control processor 20 has another software module for calculating differential pressure of inlet and outlet of the Roots blower 12, i.e., the difference between a pressure signal of the pressure sensor 15 and a pressure signal of the pressure sensor 16 for correcting engine speed set in the above-described map.

Furthermore, the control processor 20 has still another software module for, during acceleration where the engine speed is still rising in the EGR area, suspending the exhaust gas recirculation and for reversely rotating the Roots blower 12 to accelerate rise in rotation of the turbocharger 2 even in the EGR area.

Incidentally, because oxygen rate decreases relative to the injected fuel and color of the exhaust gas further blackened when exhaust gas recirculation is conducted to the diesel engine during acceleration, exhaust gas recirculation is preferably avoided during acceleration.

Further, the control processor 20 has further software module for reversely rotating the Roots blower 12 for preventing backflow from the intake side to the exhaust side in the non-EGR area, and still further software module for reversely rotating the Roots blower 12 in the non-EGR area to clean the cooler 13 for every predetermined operation time.

Figure 5:
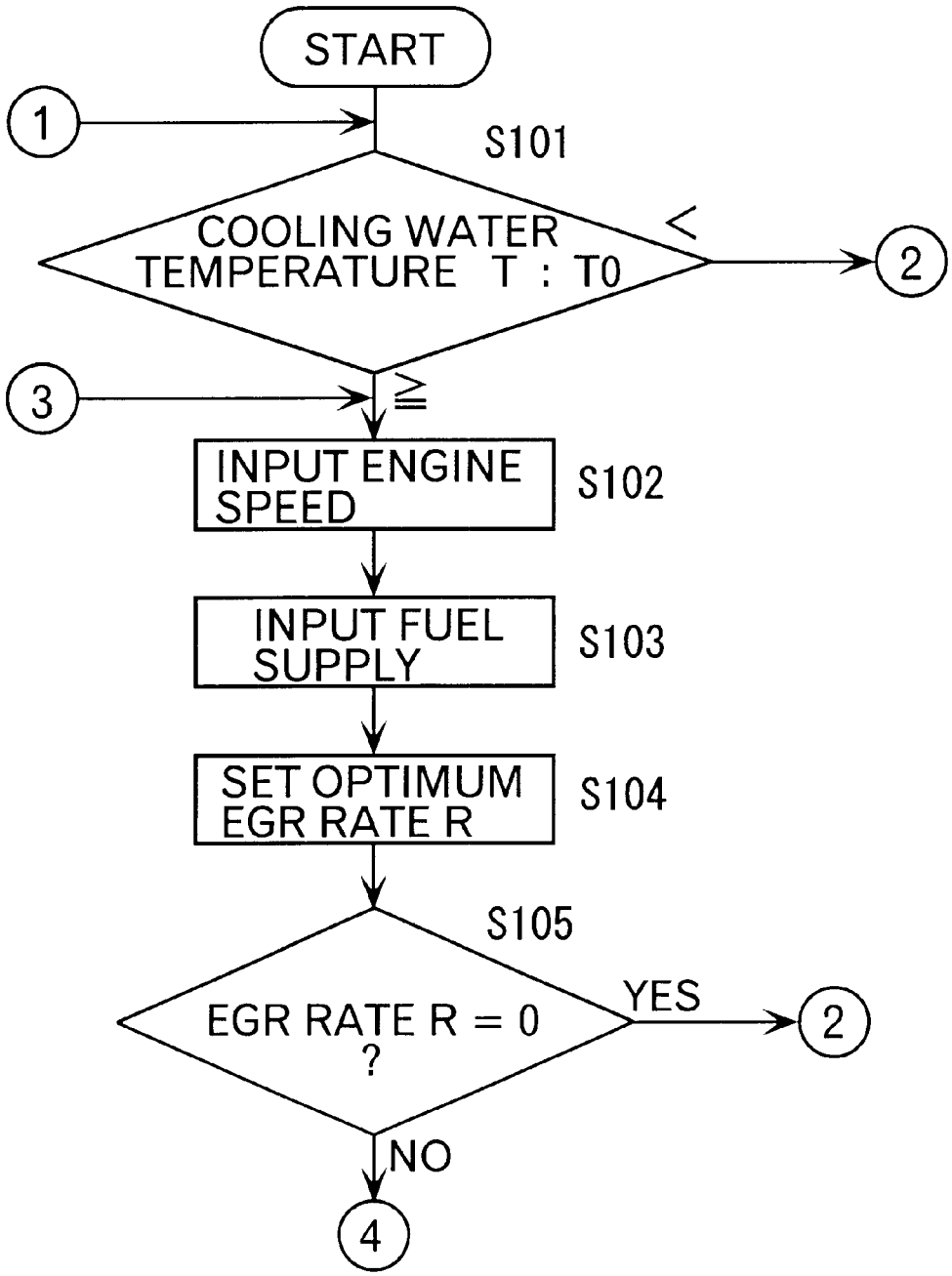
FIG. 5 is a flow chart for illustrating operation of the aforesaid embodiment.

Next, an operation of he present embodiment will be described below with reference to flow charts shown in FIG. 5 to FIG. 7.

When the diesel engine 1 is started, the software of the EGR controller 17 is actuated. The actuated EGR controller 17 receives from the engine controller 8 a cooling water temperature signal indicating a temperature T of cooling water of the engine 1. Then, as shown in FIG. 5, the EGR controller 17 checks whether or not the cooing water temperature T reaches a predetermined temperature To in a step S101. When the cooling water temperature T reaches the temperature To, the process proceeds to step S102.

On the other hand, when the cooling water temperature T does not reach the temperature To, because the engine 1 is cooled and exhaust gas recirculation is preferably avoided, the process advances to a reverse rotation operation subroutine starting from below-described step S201 (see FIG. 7).

Engine speed and fuel supply of the engine 1 are inputted during steps S102 to S104, and an optimum exhaust gas recirculation rate R in accordance with operation condition of the engine 1 is set based on the engine speed, the fuel supply, and the map in the memory 21, and the process proceeds to step S105.

In the step S105, it is checked whether or not the established recirculation rate R is 0. When the recirculation rate R is not 0, the process proceeds to a normal rotation operation subroutine starting from the step S401 (see FIG. 6).

On the other hand, when the recirculation rate R is 0, because there is no need for exhaust gas recirculation, the process proceeds to the reverse rotation operation subroutine starting from the step S202 (see FIG. 7) as in the case where the cooling water temperature T does not reach the temperature To.

Figure 6:
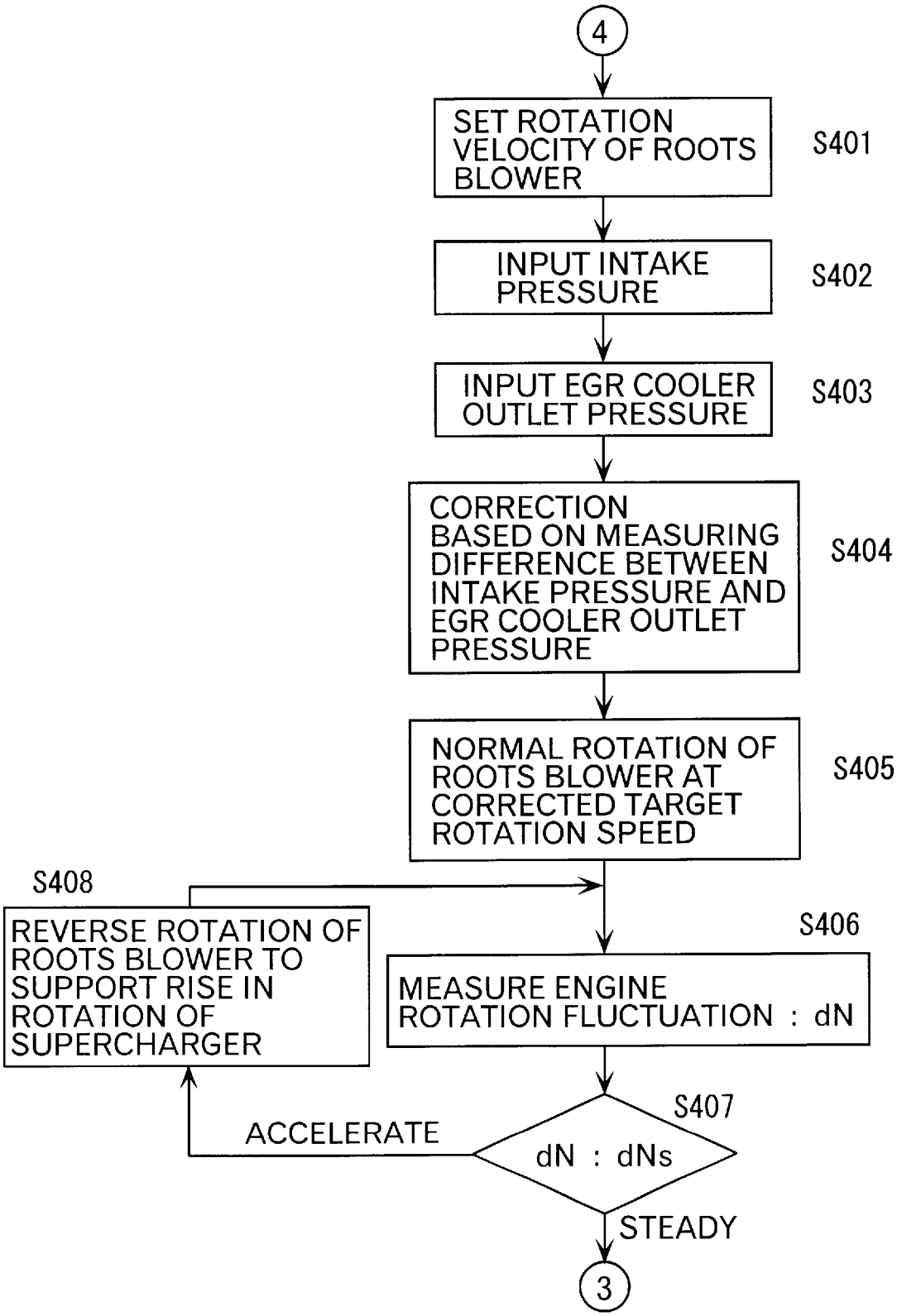
FIG. 6 is another flow chart continuing from the flow chart shown in FIG. 5.
Figure 7:
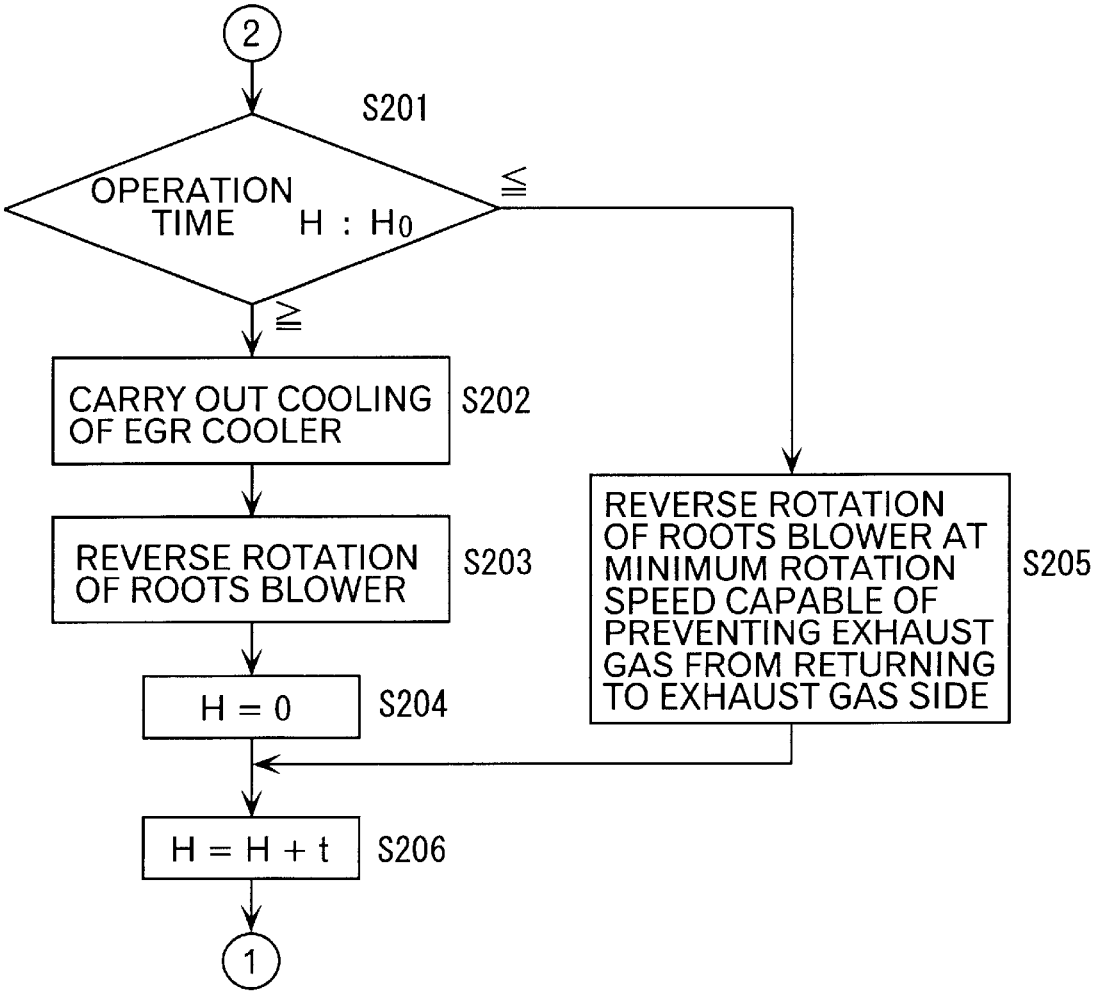
FIG. 7 is still another flow chart continuing from the flow chart shown in FIG. 5.

As shown in FIG. 6, in step S401, the rotation speed of the Roots blower 12 is set according to the engine speed, the fuel supply of the engine 1 and the map in the memory 21 to proceed to step S402.

During steps S402 to S404, the rotation speed of the Roots blower 12 is corrected based on the differential pressure between the inlet and outlet of the Roots blower 12 detected by the pressure sensors 15 and 16. Subsequently, the process proceeds to step S405 and the Roots blower 12 is normally rotated in accordance with the corrected rotation speed.

During the following step S406, engine speed fluctuation dN is calculated by the engine speed outputted by the engine controller 8, and the process proceeds to step S407. In the step S407, the calculated engine speed fluctuation dN and fluctuation dNs set at a predetermined value are compared to check whether or not the engine 1 is at a steady state where the fluctuation dN is small and the engine speed is stable or at an acceleration state where the fluctuation dN is large and the engine speed is still rising. When the engine 1 is at the steady state, the process returns to the steps S102 and the series of steps starting from the aforesaid S102 is repeated a number of times while the exhaust gas recirculation can be conducted.

On the other hand, when the engine 1 is in an accelerated state, the process advances to the step S408, where the Roots blower 12 is reversely rotated to support a rise in rotation of the turbocharger 2.

On the other hand, when exhaust gas recirculation is not conducted at the steps S101 and S105, the process advances to step S201. At the step S201, as shown in FIG. 7, whether or not the operation time H of the engine 1 has reached a predetermined time Ho is checked.

When the operation time H reaches the predetermined time Ho, the process advances to the step S202 and the Roots blower 12 is reversely rotated at the steps S202 and S203 to clean the cooler 13.

When cleaning of the cooler 13 is completed, the operation time H is reset at step S204 to advance to step S206.

On the other hand, when the operation time does not reach the predetermined time Ho, the process advances to step S205 and the Roots blower 12 is reversely rotated to avoid invasion of the exhaust gas to the intake side, and advances to the step S206.

At the step S206, the time t required for reaching the step S206 is added to the operation time H, and the step returns to the step S101 to repeat the series of steps starting from the aforesaid step S101 until the diesel engine 1 is stopped.

According to the above-described present embodiment, the following effects can be obtained.

Because the Roots blower 12 driven by the direct-current motor 14 is employed for recirculating a part of the exhaust gas of the diesel engine 1 to the intake side, the flow rate of the exhaust gas flowing through the exhaust gas recirculation duct can be controlled as desired by controlling the rotation speed of the direct-current motor 14 even when the differential pressure between the exhaust and the intake side is fluctuated, so that an optimum amount of the exhaust gas in accordance with operation of the engine 1 can be recirculated to the intake side.

Because the circulation direction of a fluid during reverse rotation of the Roots blower 12 becomes opposite to the circulation direction during of the normal rotation, even when the pressure at the exhaust side is greater than that of the intake side, the flow from the exhaust side to the intake side is not generated by reversely rotating the Roots blower 12 while the exhaust gas recirculation is not conducted. Accordingly, the control valve for preventing the flow from the exhaust side to the intake side is not necessary to be provided to the recirculation duct 11, so that an increase in the flow restriction by the provision of the control valve and decrease in exhaust gas recirculation amount in accordance with increase in the flow restriction can be prevented in advance.

Soot and other contaminants stuffed in the cooler 13 can be discharged to the exhaust side by the reverse rotation of the Roots blower 12, thus cleaning the cooler 13.

Because the Roots blower 12 can be operated at a relatively low speed, the size of the direct-current motor 14 can be made small. Further, because the size of the Roots blower 12 is smaller than the other gas feeder, increase in the size of the exhaust gas recirculation device 10 can be avoided.

Because the flow characteristics of the Roots blower 12 are similar in the normal rotation and the reverse rotation, the relationship between the rotation speed and the air feed amount is similar in the normal rotation and the reverse rotation except for the rotary direction, thus easily preventing backflow and conducting control of the rotation speed during cleaning of the cooler 13.

Because the cooler 13 for cooling the exhaust gas inhaled by the Roots blower 12 is provided, the high-temperature exhaust gas is cooled before flowing into the Roots blower 12, thus avoiding damage of the Roots blower 12 by heat. Further, the temperature of the intake air inhaled by the engine 1 does not become too high, so that combustion temperature can be securely controlled by the exhaust gas recirculation, thus lowering the generation of nitrogen oxide.

Because the exhaust gas recirculation device unit is formed by installing the recirculation duct 11, the Roots blower 12, the cooler 13, the direct-current motor 14, the pressure sensors 15 and 16, and the EGR controller 17 to the casing 18, the exhaust gas recirculation device unit can be easily attached to the diesel engine 1 by a bolt, etc.

Accordingly, the exhaust gas recirculation device 10 can be easily installed to a conventional internal combustion engine having no exhaust gas recirculation device.

When the diesel engine 1 is run at a place with thin air such as a place at a high altitude where the engine 1 does not work stably at a high load with exhaust gas recirculation, the exhaust gas recirculation device unit can be detached from the engine 1, so that the engine 1 can be operated stably at high load. Incidentally, the nitrogen oxide in the exhaust gas can be reduced at the place with thin air even without the exhaust gas recirculation.

On the other hand, the nitrogen oxide contained in the exhaust gas of the engine 1 can be reduced by attaching the exhaust gas recirculation device unit to the engine 1.

Because the engine speed of the engine 1 and the fuel supply to the engine 1 are detected, because the memory 21 storing the map indicating the rotation speed of the Roots blower 12 capable of obtaining the optimum exhaust gas recirculation in accordance with the engine speed and the fuel supply is provided, and because the rotation speed of the Roots blower 12 is set by the control processor 20 based on the map of the memory 21, the air feed amount of the Roots blower 12 can be rapidly controlled, thus recirculating an optimum amount of the exhaust gas in accordance with operation condition of the engine 1.

Further, because the direct-current motor 14 is employed for the drive source of the Roots blower 12, switching of the normal and reverse rotation and control of the rotation speed can be easily and rapidly conducted, so that an always optimum exhaust gas recirculation amount can be obtained in accordance with an operation condition of the engine 1.

Figure 8:
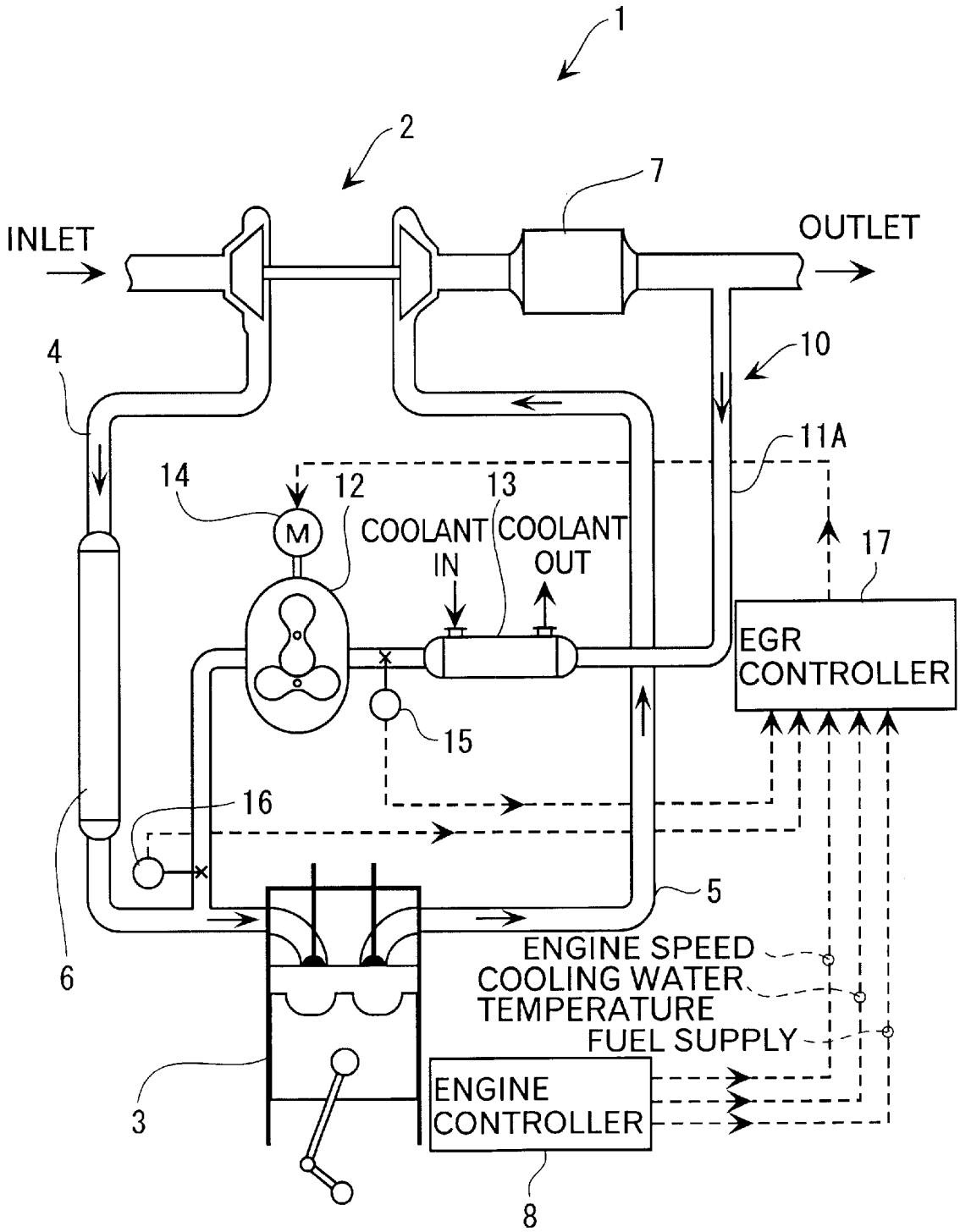
FIG. 8 is an illustration corresponding to FIG. 1 showing a second embodiment of the present invention.

FIG. 8 shows the second embodiment of the present invention. In the second embodiment, the exhaust gas is extracted from downstream of the catalyst 7 as opposed to the first embodiment where the exhaust gas is extracted from upstream of the turbocharger 2.

In other words, a recirculation duct 11A for connecting the intake duct 4 and the exhaust duct 5 has an end connected to downstream of the inter cooler 6 of the intake duct, and the other end connected to downstream of the catalyst 7 of the exhaust duct 5.

In the above-described second embodiment, the same function and effect as the first embodiment can be obtained. Further, because the exhaust gas is extracted from a downstream side of the catalyst 7, the exhaust gas returning to the intake side is cleaned and the temperature of the exhaust gas is reduced, thus decreasing damage and abrasion of the equipment such as the Roots blower 12 installed on the recirculation duct 11A and the volume of the cooler 13 can be reduced.

Figure 9:
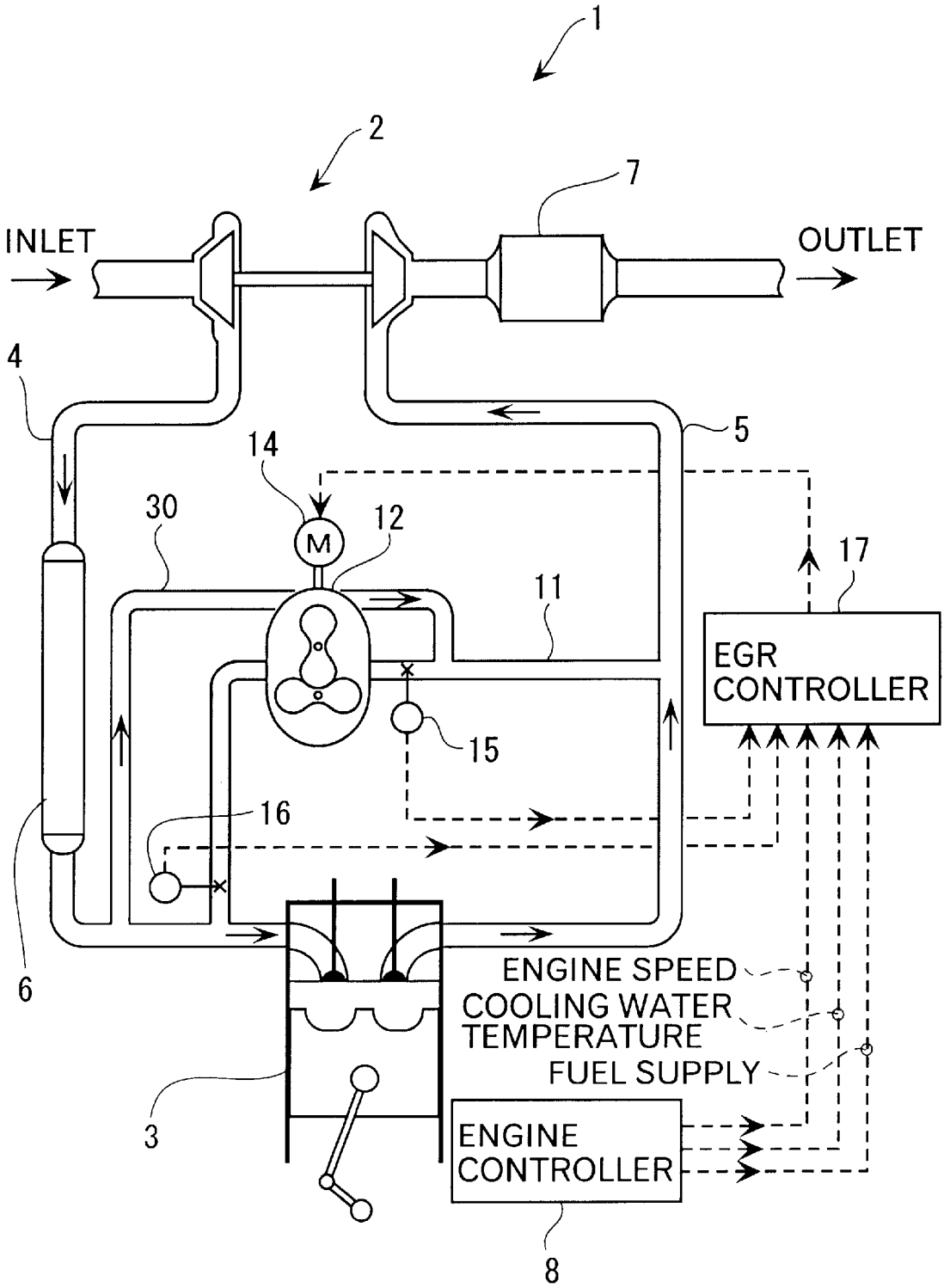
FIG. 9 is an illustration corresponding to FIG. 1 showing a third embodiment of the present invention.

FIG. 9 shows the third embodiment of the present invention. The third embodiment cools the recirculating exhaust gas by mixing intake air flowing through the intake duct 4 with the exhaust gas, as opposed to the first embodiment where the recirculating exhaust gas is cooled by the cooler 13.

In other words, as shown in FIG. 9, the cooler 13 is omitted from the recirculation duct 11 and an end of the cooling air duct 30 for introducing the intake air cooled by the inter cooler 6 to the recirculation duct 11 is connected to a downstream side of the inter cooler 6 provided to the intake duct 4.

The other end of the cooling air duct 30 is connected to the recirculation duct 11 at an intermediate position between the Roots blower 12 provided on the recirculation duct 11 and the exhaust duct 5. The cooling air duct 30 is an air-mixer for mixing air on the intake side to the exhaust gas recirculating to the intake side.

According to the third embodiment, because the exhaust gas is cooled by mixing the intake air flowing in the intake duct 4, the same function and effect as the first and the second embodiments can be obtained. And, furthermore, because the cooler 13 is omitted from the recirculation duct 11, the flow restriction of the recirculation duct 11 can be reduced, thus decreasing the load applied to the Roots blower 12.

Figure 10:
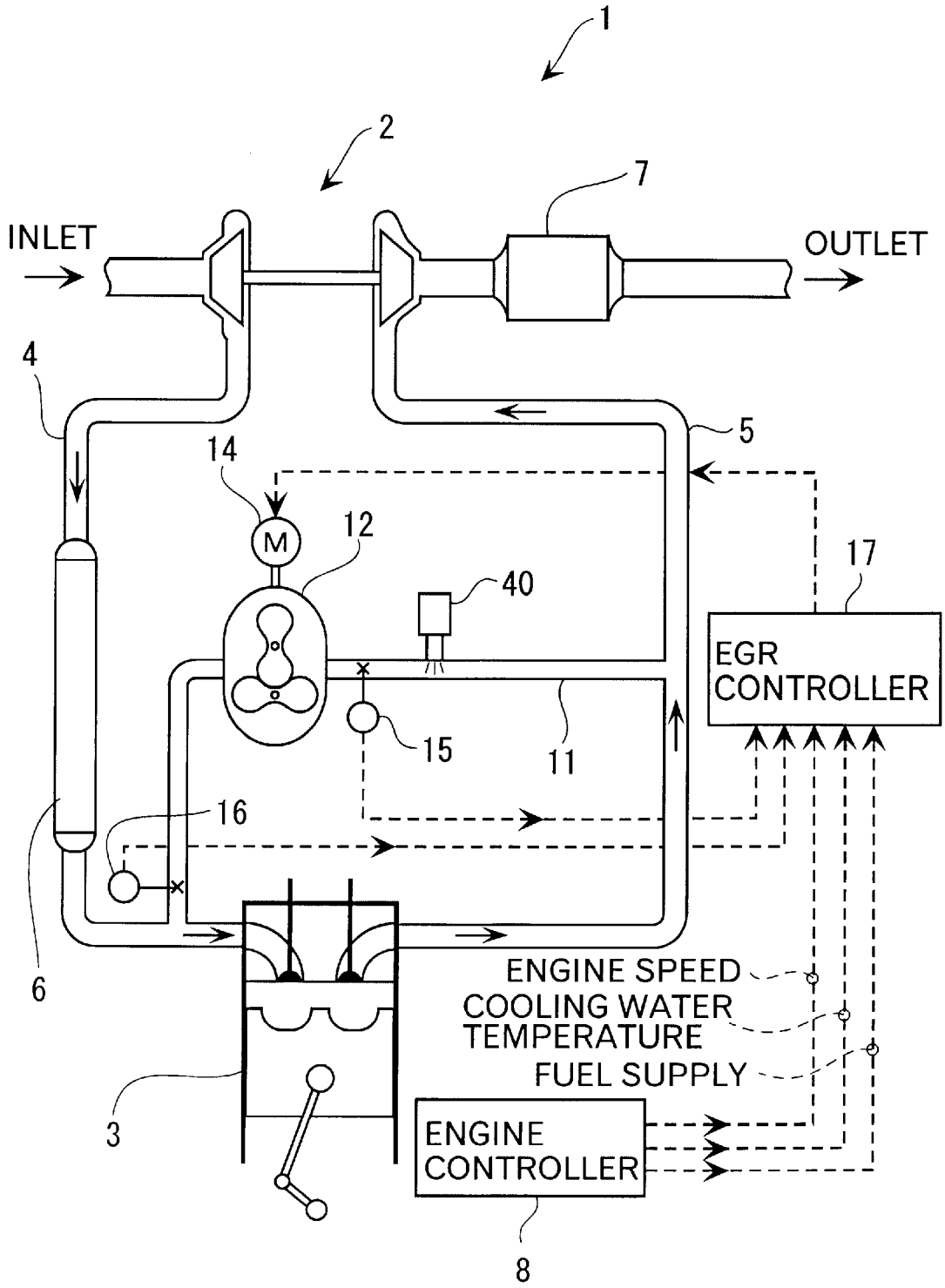
FIG. 10 is an illustration corresponding to FIG. 1 showing a fourth embodiment of the present invention.
Figure 11:
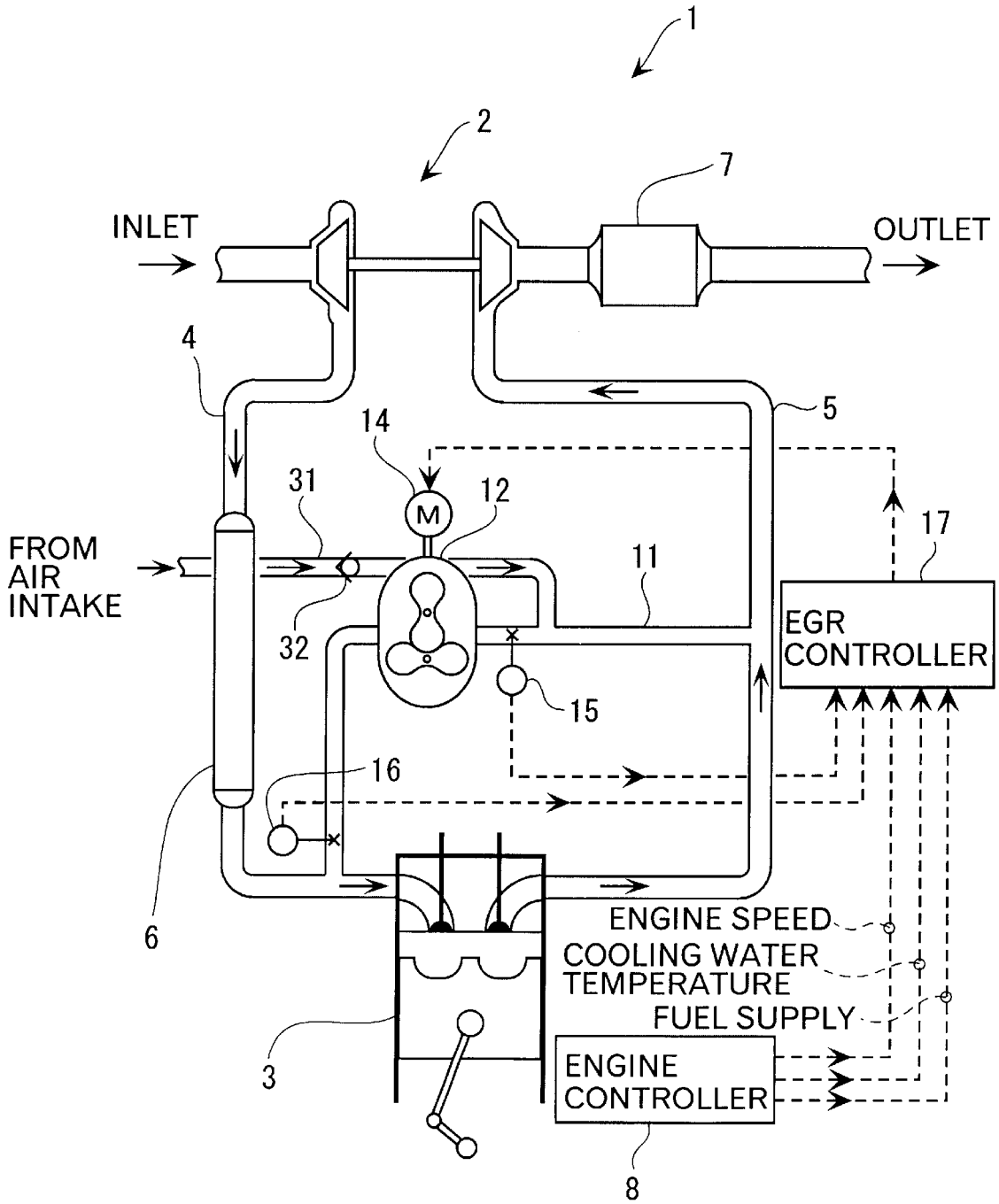
FIG. 11 is an illustration showing a modification of the third embodiment of the present invention.

FIG. 10 shows the fourth embodiment of the present invention. The fourth invention cools the recirculating exhaust gas by mixing water into the exhaust gas flowing in the recirculation duct 11 as opposed to the third embodiment where the recirculating exhaust gas is cooled by the cooler 13.

Specifically, the cooler 13 is omitted from the recirculating duct 11 as shown in FIG. 10 and a water injector 40 for injecting water into the recirculation duct 11 is provided at an intermediate position between the Roots blower 12 and the exhaust duct 5. The water injector 40 is a water mixer for mixing water into the exhaust gas recirculating to the intake side.

According to the fourth embodiment, because the exhaust gas is cooled by mixing water, the same function and effect as the first to the third embodiments can be obtained. And, further, because the intake air containing water is inhaled by the cylinder 3 of the engine 1, the combustion temperature can be lowered, thus enhancing the nitrogen oxide reduction effect.

Though preferred embodiments of the present invention have been described thus far, the scope of the present invention is not restricted to the above embodiments, but includes various improvements and changes in design as long as an object of the present invention can be attained.

For instance, the supercharger is not restricted to a turbocharger, but may be a mechanical supercharger driven by a driving source, such as specially-installed electric motor.

The internal combustion engine is not restricted to a compression ignition diesel engine but maybe spark-ignition internal combustion engine such as spark-ignition type reciprocating gasoline engine and rotary engine, or a natural intake internal combustion engine without supercharger.

Further, the gas feeder is not restricted to the Roots blower, but may be an air blower such as axial-flow air blower and centrifugal air blower, and compressor such as reciprocating compressor, screw compressor, vane compressor, scroll compressor, axial-flow compressor or centrifugal compressor. However, the above-described effects can be obtained by employing the Roots blower.

The drive source is not restricted to the direct-current motor, but may be an alternating-current motor, hydraulic motor or air motor, or alternatively, the internal combustion engine itself may be employed instead of the drive source independent from the internal combustion engine.

When the internal combustion engine itself is employed as the drive source, a clutch for suspending drive force to the gas feeder and a transmission for increasing and decreasing rotation speed such as a torque converter may preferably be provided between the gas feeder and the internal combustion engine.

Further, although one of the cooling air duct as the air mixer, the water injector as the water mixer and the cooler 13 is provided as the cooling device for cooling the recirculated exhaust gas, the exhaust gas recirculating device is not restricted to having only one of the cooling device, but may have a plurality of the above cooling devices.

Further, the air mixer is not restricted to mix the low-temperature intake air flowing through the intake duct 4 with the high-temperature exhaust gas, but may have an air intake 31 for introducing fresh air from the outside independent from the intake duct 4, so that the recirculating exhaust gas is cooled by the outside fresh air introduced separately from the combustion air.

In the above arrangement, the air intake 31 preferably has a check valve 32.

What is claimed is:

1. An exhaust gas recirculation device for extracting a part of an exhaust gas of an internal combustion engine and recirculating the exhaust gas into an intake side, comprising a gas feeder capable of rotating in both normal and reverse directions installed in a recirculation duct connecting an exhaust duct and an intake duct of the internal combustion engine.

2. The exhaust gas recirculation device according to claim 1, further comprising an air mixer between the gas feeder and an exhaust side of the internal combustion engine for mixing outside fresh air with the exhaust gas recirculating to the intake side.

3. The exhaust gas recirculation device according to claim 1, further comprising a water mixer between the gas feeder and an exhaust side of the internal combustion engine for mixing water with the exhaust gas recirculating to the intake side.

4. The exhaust gas recirculation device according to claim 1, further comprising a cooler between the gas feeder and an exhaust side of the internal combustion engine for cooling the exhaust gas recirculating to the intake side.

5. The exhaust gas recirculation device according to claim 4, wherein the gas feeder, a drive source for driving the gas feeder and the cooler are integrated as a unit.

6. The exhaust gas recirculation device according to claim 1, wherein a rotation of the gas feeder in the normal direction circulates fluid in reverse to a rotation of the reverse direction, and wherein a controller for controlling the gas feeder is provided, the controller controlling rotary direction of the gas feeder in accordance with an operation condition of the internal combustion engine and reversely rotating the gas feeder when the exhaust gas is not recirculated to the internal combustion engine.

7. The exhaust gas recirculation device according to claim 1, wherein the gas feeder is a Roots blower.

8. The exhaust gas recirculation device according to claim 1, wherein a catalyst for cleaning exhaust gas is provided to the exhaust duct of the internal combustion engine, and wherein the part of the exhaust gas is extracted from a downstream of the catalyst to be recirculated.

9. The exhaust gas recirculation device according to claim 1, wherein the gas feeder is capable of adjusting-air feed flow rate, and wherein the exhaust gas recirculation device has an engine speed detector for detecting an engine speed of the internal combustion engine, a fuel supply detector for detecting fuel supply to the internal combustion engine, a memory for storing a map indicating a rotation speed of the gas feeder capable of obtaining an optimum exhaust gas recirculation amount in accordance with the engine speed of the internal combustion engine and the fuel supply to the internal combustion engine, and a controller for adjusting the air feed flow rate of the gas feeder based on the map stored in the memory in accordance with an operation condition of the internal combustion engine.

10. A control method of an exhaust gas recirculation device for extracting a part of exhaust gas of an internal combustion engine to recirculate to an intake side, comprising the steps of:

providing to the exhaust gas recirculation device a gas feeder capable of rotating in both normal and reverse directions installed in a recirculation duct for connecting an exhaust duct and an intake duct of the internal combustion engine and a drive source for driving the gas feeder, the gas feeder controlling a rotation speed of the drive source to control air feed flow rate; and controlling a rotation speed of the drive source to obtain an optimum exhaust gas recirculation amount in accordance with operation condition of the internal combustion engine.

11. A control method of an exhaust gas recirculation device for extracting a part of exhaust gas of an internal combustion engine to recirculate to an intake side, comprising the steps of:

providing to the exhaust gas recirculation device with a gas feeder installed to a recirculation duct for connecting an exhaust duct and an intake duct of the internal combustion engine and a drive source for driving the gas feeder, the gas feeder being capable of rotating in both normal and reverse directions, rotation in the reverse direction circulating fluid in a direction reverse to rotation in the normal direction; and reversely rotating the gas feeder to prevent backflow from the intake side to the exhaust side when the exhaust gas is not recirculated to the internal combustion engine.

* * * * *